US009857085B2

(12) United States Patent
Braden et al.

(10) Patent No.: US 9,857,085 B2
(45) Date of Patent: Jan. 2, 2018

(54) HOME APPLIANCE HAVING A SIDE SHIELD

(71) Applicants: BSH Home Appliances Corporation, Irvine, CA (US); BSH Bosch und Siemens Hausgeräte GmbH, Munich (DE)

(72) Inventors: Ben Braden, Lafollette, TN (US); Richard Moyers, Morristown, TN (US); Timothy Russell, Jacksboro, TN (US); Michael Rutherford, Duff, TN (US)

(73) Assignees: BSH Home Appliances Corporation, Irvine, CA (US); BSH Hausgeräte GmbH, Munich (DE)

( * ) Notice: Subject to any disclaimer, the term of this patent is extended or adjusted under 35 U.S.C. 154(b) by 241 days.

(21) Appl. No.: 14/603,473

(22) Filed: Jan. 23, 2015

(65) Prior Publication Data

US 2016/0215988 A1 Jul. 28, 2016

(51) Int. Cl.

| | |
|---|---|
| ***F24C 15/30*** | (2006.01) |
| ***F24C 15/20*** | (2006.01) |
| *F24C 15/00* | (2006.01) |

(52) U.S. Cl.

CPC ..... *F24C 15/2042* (2013.01); *F24C 15/006* (2013.01); *F24C 15/30* (2013.01)

(58) Field of Classification Search

CPC ..... F24C 15/006; F24C 15/322; F24C 15/30
USPC ..... 126/21 A, 21 R, 15 A, 15 R, 273; 219/757
See application file for complete search history.

(56) References Cited

U.S. PATENT DOCUMENTS

| | | | | |
|---|---|---|---|---|
| 1,706,389 | A | 3/1929 | Bayliss | |
| 3,682,156 | A * | 8/1972 | Perl | F24C 15/2007 126/21 A |
| 3,783,854 | A * | 1/1974 | Hurko | F24C 14/025 126/21 R |
| 4,184,473 | A | 1/1980 | McIntire et al. | |
| 4,383,518 | A | 5/1983 | Beausoleil | |
| 4,763,638 | A * | 8/1988 | Hurley | F24C 14/025 126/21 A |
| 4,865,010 | A * | 9/1989 | Kett | F24C 15/2007 126/21 R |
| 6,761,159 | B1 * | 7/2004 | Barnes | F24C 15/2007 126/15 R |

(Continued)

FOREIGN PATENT DOCUMENTS

| | | |
|---|---|---|
| EP | 0671591 B1 | 2/1999 |
| EP | 2489942 A1 | 8/2012 |

(Continued)

OTHER PUBLICATIONS

Draglink, Open Raods Forum, RV.net, Mar. 22, 2011, p. 22.

*Primary Examiner* — Gregory Huson
*Assistant Examiner* — Nikhil Mashruwala
(74) *Attorney, Agent, or Firm* — Michael E. Tschupp; Andre Pallapies; Brandon G. Braun

(57) ABSTRACT

A home cooking appliance includes a housing having a side wall, a cooking compartment in the housing, an exhaust channel that exhausts air from the cooking compartment, and a side shield disposed between the side wall and the air flowing in the exhaust channel and forming an air gap between the side wall and the exhaust channel.

36 Claims, 12 Drawing Sheets

(56) References Cited

U.S. PATENT DOCUMENTS

| | | | | |
|---|---|---|---|---|
| 7,762,250 | B2 * | 7/2010 | Elkasevic | F24C 15/006 126/190 |
| 2016/0215987 | A1 * | 7/2016 | Braden | F24C 15/006 |

FOREIGN PATENT DOCUMENTS

| | | | |
|---|---|---|---|
| KR | 100272362 | B1 | 12/2000 |
| WO | 2013098251 | A1 | 7/2013 |

* cited by examiner

400

400

HOME APPLIANCE HAVING A SIDE SHIELD

CROSS-REFERENCES TO RELATED APPLICATION

This application is related to Applicants' co-pending U.S. application, which is filed concurrently herewith, entitled "HOME APPLIANCE HAVING AN AIR GAP INSULATOR", Ser. No. 14/603,472, which is incorporated herein by reference in its entirety.

FIELD OF THE INVENTION

The present invention is directed to a home cooking appliance having a rear vent trim, and more particularly, to a home cooking appliance having a rear vent trim including a side shield.

BACKGROUND OF THE INVENTION

A conventional home cooking appliance, such as a Free Standing Range (FSR), includes a housing having a cooking compartment, such as a baking oven, convection oven, steam oven, warming drawer, etc., and a cooking surface formed, for example, by cooking grates disposed over gas burners on top of the housing. A conventional range (e.g., free standing, slide-in, etc.) is installed in a cooking area of a home kitchen with a rear wall of the appliance facing a back wall of the kitchen. The appliance typically is disposed between counters with floor cabinets below the counters. The kitchen may include wall cabinets mounted on the back wall of the kitchen either over the cooking surface of the range or over the adjacent floor cabinets, and/or another appliance or component, such as an over-the-range (OTR) microwave oven or an OTR convection microwave oven over the cooking surface.

Industry standards and regulations commonly dictate acceptable door and other surface temperatures of the combustible back wall behind the appliance, acceptable temperatures of cabinets or components over the range or adjacent to the range, as well as acceptable door temperatures for the appliance, during high temperature events, such as during a normal baking and/or self-cleaning cycle of the oven while all burners on the cooktop are on a highest heat setting. The appliance must be able to exhaust cooling air and flue gases from the cooking compartment to maintain acceptable door temperatures for the appliance, acceptable surface temperatures for the appliance, acceptable temperatures of a combustible back wall behind the appliance, and acceptable temperatures of cabinets or components over the range or adjacent to the range.

Conventional appliances include various structures and techniques designed to manage and dissipate the hot air being exhausted from the appliance while complying with industry standards and regulations. In order to provide enough air flow through the appliance to maintain acceptable surface temperatures and oven door temperatures and to protect components in and around the appliance, many conventional appliances use costly designs and door construction that increases the air flow through the door and the housing, and/or use greater air flow and louder fans. Additionally, conventional home cooking appliances may require a rear wall of the appliance to be spaced from the combustible back wall by a certain amount of clearance in order to manage and dissipate hot air from the appliance in order to improve compliance with the industry standards and regulations.

For example, a conventional Free Standing Range (FSR) may be provided with a rear vent trim kit or assembly, which adapts the FSR for the environment in which the FSR is placed. The FSR may include an "island" trim kit which adapts the FSR for installation in an island location, or a "low back" trim kit which adapts the FSR for placement with a rear wall of the appliance adjacent to a back wall of a home kitchen. A low back trim kit may be arranged to space the FSR away from the back wall so that air is permitted to circulate between the back wall to keep the back wall cooler than the FSR and also to provide a space into which exhaust gases and/or cooling ventilation from the FSR may be vented. The FSR can include one or more ventilation fan outlets from which the FSR exhausts cooling air. The temperature differences in the air in the space protected by the conventional low back trim kit enables a convection of air to be established in a vertical direction from the fan outlets upward into the low back trim kit and the air is guided out a vent trim opening in a back of the rear vent trim kit.

SUMMARY OF THE INVENTION

An exemplary embodiment of the invention comprises a home cooking appliance including a housing having a side wall and a rear wall, a cooking compartment in the housing, an exhaust channel that exhausts air from the cooking compartment, and a side shield disposed between the side wall and the air flowing in the exhaust channel and forming an air gap between the side wall and the exhaust channel. In this way, the present invention can reduce an amount of heat transferred from the air flowing through an exhaust channel to the side wall of the appliance, and more particularly to the exposed side walls of the rear vent trim of the appliance, thereby limiting or reducing excessive heat exposure to a user and/or a back wall, side wall, or cabinetry, etc. of the kitchen to which the wall of the appliance is adjacent.

Other features and advantages of the present invention will be described below. To provide a better understanding of the invention, and for further clarification and background of the present invention, various aspects and considerations of a home cooking appliance having a rear vent trim, which have been recognized by the present invention, first will be explained in greater detail.

As explained above, a home cooking appliance, such as a Free Standing Range (FSR), may be provided with a rear vent trim kit or assembly, which adapts the FSR for the environment in which the FSR is placed. The trim kit forms an exhaust channel that guides air from within the appliance, such as hot flue gases from the oven compartment, in a vertical direction from the fan outlets of the oven flues upward into the rear vent trim, where the exhaust air is guided out the vent opening in the rear vent trim. A rear vent trim can take various forms depending on the particular appliance, arrangement of cooking compartment(s), cooktop or burners, desired aesthetics of the appliance, and/or the location in which the appliance will be installed, such as adjacent to a kitchen wall, in a kitchen island, adjacent to cabinetry or other accessories such as a fume hood, etc., among other things. For example, the rear vent trim can be configured to be raised up from the cooking surface by various amounts such as a high back, low back, high shelf, etc., or substantially flush with the top of the appliance or cooking surface. The rear vent trim can include a vent opening for exhausting air from within the appliance. The rear vent trim can be configured to control and manage the flow of the exhausted air (e.g., hot air/flue gas) to minimize temperatures on a user and adjacent surfaces, such as surfaces of kitchen cabinetry adjacent to or above the appliance, surfaces of a combustible back wall of the kitchen, etc. In this way, the rear vent trim can improve compliance of the appliance with industry standards and regulations and maintain passing combustion results at the gas burners, while also improving comfort of a user, for example, by minimizing a temperature of air flowing toward the user, minimizing noise to the user, etc.

The rear wall of the appliance typically is inaccessible or not exposed to a user during operation of the appliance when the appliance is up against the back wall of a kitchen. However, with a rear vent trim that rises up from the cooking surface, such as a high back, low back, high shelf, etc., the side walls of the rear vent trim may exposed above the top of the appliance and/or be accessible from the side of the appliance due to the adjacent cabinetry or counters being level with the top of the appliance. As a result, it may be more likely that a user, or even an item on an adjacent counter, may come into contact with the side walls of the rear vent trim. Given the excessive temperatures potentially seen within an exhaust channel of an oven, the present invention recognizes that, during operation of the cooking compartment, heat from the hot flue gases being exhausted through the rear vent trim can be transferred to one or more side walls of the rear vent trim or the appliance, thereby potentially exposing a user to excessive heat or heated surfaces, as well as exposing adjacent walls, cabinets, etc. to excessive heat. The heat transfer also may increase a temperature of the side wall of the appliance, which may affect compliance with industry standards, etc. The present invention recognizes that further solutions are needed to address the additional considerations associated with such high back, low back, high shelf vent trims.

These problems and others are addressed by the present invention, which provides a home cooking appliance including a rear vent trim having a side shield that is spaced off of the side wall of the appliance, and more particularly to the side wall(s) of the rear vent trim of the appliance, thereby protecting and establishing an air gap between the side wall of the rear vent trim and the upward flow of air, which flows through the exhaust channel of the rear vent trim from the oven flue(s). In this way, the present invention can provide a rear vent trim that controls a flow of air exhausting from the appliance while also reducing the amount of heat transferred from the oven exhaust vents to the side wall of the appliance, and more particularly to the exposed side walls of the rear vent trim of the appliance, thereby limiting or reducing the temperature exposure to a user or adjacent items, accessories, cabinetry, etc.

The present invention recognizes that the temperature of the side walls of the rear vent trim also may affect temperatures at the rear wall closer to the side walls, for example, where heat may accumulate from multiple sources. By controlling a temperature at the side walls, the present invention also may minimize or eliminate a required minimum clearance between the rear wall of the appliance and a combustible back wall of the kitchen, which faces the rear wall of the appliance, and contribute to maintaining compliance with industry standards and regulations.

The side shield can be positioned adjacent to a surface of the side wall (e.g., an inner surface of the side wall) that is subject to temperature increases during operation of the appliance, such as a surface that is adjacent to or directly faces the exhaust channel from the oven flues. A side shield can be configured to form an air gap between the side shield and an inner surface of the side wall of the appliance. The air gap can reduce the amount of heat that is transferred from the side shield (which is heated by the hot air that flows from the oven flue through the exhaust channel) to the side wall. As a result, during operation of the appliance, a temperature of the side wall is less than a temperature of the side shield, which in turn limits or reduces the temperature exposure to a user.

The particular location, arrangement, size, and shape of the side shield can vary depending on the particular physical dimensions of one or more components of the appliance, such as an amount of available space between the flue fan exits and the side walls, the deflector, etc., the oven vent location(s), the number of oven vents or oven flues, the air flow through the exhaust channel, etc.

The side shield can be configured to substantially minimize or prevent air from flowing into the air gap from the exhaust channel, thereby minimizing or preventing hot air from the exhaust channel from directly contacting the surface of the side wall that faces the air gap. The side shield can be configured to restrict or prevent any air flow in the air gap, but preferably is not completely closed off with a solid wall or solid surface in a manner that creates an area of limited or no air flow, which may result in a hot spot (e.g., an accumulation of higher temperature air). In an exemplary embodiment, the side shield can be configured to be open at least at an upstream end of the side shield or at both ends of the side shield. The upstream end of the side shield can be configured to extend past (e.g., below) an exit of the oven flue (e.g., below the top of the oven flue), thereby restricting or preventing air from the oven flue from entering the air gap formed between the side shield and the side wall. The open end or ends of the side shield can be configured to permit some air to enter the gap, for example from air slots in the rear wall of the appliance, thereby improving cooling within the air gap.

In another embodiment, the side shield can include a layer of insulation, such as insulation typically used in oven applications, granular insulations, etc., in the air gap formed between the side shield and the side wall. The insulation can not only serve to further limit a transfer of heat from the exhaust channel to the side walls, but also can reduce or restrict air flow into the gap to prevent heated air from flowing into the gap without entirely cutting off air flow in the gap. In this way, the side shield having insulation in the air gap can permit some limited or minimal movement of air within the insulation in the gap, which may assist with cooling while at the same time reducing or eliminating the possibly of a hot spot forming, and/or reducing or eliminating the flow of air from the exhaust channel into the gap.

The side shield can be mounted on the appliance such that the side shield does not contact the side wall of the appliance, thereby minimizing or preventing the side wall from conducting heat from the side shield. The side shield can be spaced by a minimal amount or clearance from a surface of the side wall, thereby restricting or eliminating heat transfer from one solid to another solid (e.g., metal to metal). In this way, the exemplary embodiments of the side shield can significantly reduce the temperature of the side wall of the appliance and particularly the side wall of the rear vent trim assembly. This arrangement also may limit or reduce an amount of heat that is dispersed or conducted throughout the side wall to other portions of the side wall or adjacent rear wall, away from the particular location of the side shield. The side shield can be formed, for example, without a wall on the side facing the side wall, thereby minimizing the amount of material of the side shield that is in proximity to the side wall, which may further minimize or prevent the side wall from conducting heat from the side shield.

In an example embodiment, the side shield can be configured such that a portion of the side shield that comes into direct contact with the heated air in the exhaust channel can be at least partially isolated from conducting heat to other portions of the side shield that contact other surfaces of the appliance, such as surfaces of one or more flanges that contact other surfaces of the appliance when the side shield is in a mounted position on the appliance. For example, the side shield can include one or more openings, cutouts, slots, holes, notches, or the like between a plate portion, which comes into direct contact with the heated air in the exhaust channel, and the mounting flange(s), thereby reducing an amount of material in the side shield that may conduct heat between the portions of the side shield, which in turn may reduce an amount of heat transferred by the side shield to other components or surfaces of the appliance. The one or more openings, cutouts, slots, holes, notches, or the like, can be formed, for example, along a bend or fold between the plate portion and the mounting flange(s). Additionally or alternatively, the one or more openings, cutouts, slots, holes, notches, or the like, can be formed in other locations that may reduce or limit an amount of heat that is conducted from one portion of the side shield to another portion of the side shield. For example, the one or more cutouts, slots, holes, or the like, can be disposed only on the plate portion between a first part of the plate portion, which comes into direct contact with the air in the exhaust channel, and a second part of the plate portion, which does not come into direct contact with the air in the exhaust channel, such as a part of the plate that is covered, or prevented from direct contact with the air, by an adjacent component (e.g., an air gap insulator, which covers a part of the side shield facing the exhaust channel, as described in more detail below).

The one or more cutouts, slots, holes, or the like, may be configured to permit some cooling air, for example from air slots in the rear wall of the appliance, to enter the gap between the side shield and the side wall, thereby improving cooling within the air gap.

The side shield can be configured to provide for a smooth flow of air over the surface of the side shield. For example, the surface of the side shield facing the exhaust channel can be a planar surface, angled surface, or curved surface to smooth the flow of air over the surface of the side shield and/or prevent a build-up of heat along the surface of the side shield, for example due to stagnant air.

An embodiment of the present invention provides an air gap insulator disposed between the rear wall and the air flowing in the exhaust channel and forming another air gap between the rear wall and the exhaust channel. In this way, the embodiment can reduce an amount of heat transferred from the air flowing through an exhaust channel to the rear wall of the appliance. The side shield and air gap insulator can be configured to cooperate to reduce an amount of heat transferred from the air flowing through an exhaust channel to the rear wall of the appliance and the side wall of the appliance.

The air gap insulator can be positioned on a surface of the rear wall (e.g., an inner surface of the rear wall) that is subject to temperature increases during operation of the appliance, such as a surface that is adjacent to or directly faces the exhaust channel from the oven flues. The air gap insulator can be mounted to the rear wall and configured to form an air gap between the air gap insulator and an inner surface of the rear wall of the appliance. The air gap can reduce the amount of heat that is transferred from the air gap insulator (which is heated by the hot air that flows from the oven flue through the exhaust channel) to the rear wall. As a result, during operation of the appliance, a temperature of the rear wall is less than a temperature of the air gap insulator, which in turn limits or reduces the temperature exposure to a back wall of the kitchen to which the wall of the appliance is adjacent. The particular location, arrangement, size, and shape of the air gap insulator can vary depending on the particular physical dimensions of one or more components of the appliance, such as an amount of available space between the flue fan exits and the deflector, the oven vent location(s), the number of oven vents or oven flues, the air flow through the exhaust channel, etc.

The air gap insulator can be configured to substantially close off the air gap from the air flowing in the exhaust channel, thereby minimizing or preventing hot air from the exhaust channel from directly contacting the surface of the rear wall adjacent to the air gap. The arrangement may result in a pressure difference between the air gap and the exhaust channel, and more particularly, may provide a lower pressure in the air gap than in the exhaust channel. At the same time, the air gap insulator can be configured to loosely contact the rear wall, or to be spaced by a minimal amount or clearance from the rear wall (e.g., entirely spaced apart). As a result, the heat transfer from one solid to another solid (e.g., metal to metal) can be substantially limited to heat transfer through the one or more fixation devices, such as rivets, screws, or the like. In some example embodiments, the air gap insulator can be mounted on the appliance such that the air gap insulator does not contact, or is substantially free of contact with, the rear wall of the appliance, thereby minimizing or preventing the rear wall from conducting heat from the air gap insulator. In this way, the exemplary embodiments of the air gap insulator can significantly reduce the temperature of the rear wall of the appliance and rear vent trim assembly. This arrangement also may limit or reduce an amount of heat that is dispersed or conducted throughout the rear wall to other portions of the rear wall, away from the particular location of the air gap insulator.

Such minimal spacing or clearance between the air gap insulator and the rear wall can provide additional advantages in that the spacing or clearance can permit air (e.g., small amounts of air) to be drawn into the low pressure area of the air gap, for example, from within the appliance housing or from openings in the rear wall, which may provide some cooling of the air gap insulator and/or generate a flow of cooler air within the air gap, which may limit or reduce heat transfer from the air gap insulator to the rear wall.

In an example embodiment, a surface of the side shield that is exposed to the air in the exhaust channel can be positioned to extend in a direction of the air flow along and adjacent to an end of the air gap insulator. A gap or clearance can be provided between the end of the air gap insulator and the side shield to permit some air (e.g., small amounts of air) to be drawn into the low pressure area of the air gap of the air gap insulator. The gap or clearance also may permit some air (e.g., small amounts of cooling air) to flow between the air gap formed by the side shield and the air gap formed by the air gap insulator, for example, via the one or more openings, cutouts, slots, holes, notches, or the like, in the side shield.

In an example embodiment, the side shield can be positioned with respect to the air gap insulator such that an opening or gap in the end of the air gap insulator facing the side shield is exposed (i.e., not covered by the side shield). The opening or gap may permit some air (e.g., small amounts of air) to be drawn into the low pressure area of the air gap of the air gap insulator, for example, from vent openings formed in the rear wall of the appliance.

The present invention further provides a rear vent trim and rear wall assembly that is configured to control an angle of the air exiting the vent opening. An exemplary embodiment includes an oven vent trim having a deflector within an exit opening of the rear vent trim that optimizes and controls the flow of air exiting the rear vent trim from the vent opening such that the air flows in a predetermined direction, such as in a direction away from the back wall of the kitchen and above the top of the appliance, thereby minimizing or avoiding an impingement on the air flow through the rear vent trim, minimizing or avoiding a build-up of heat within the rear vent trim, and providing a smooth continuous flow of the air through the rear vent trim. The deflector is configured to minimize or prevent air from being reflected off of the back wall of the kitchen or other adjacent surfaces, or off of other surfaces of the appliance such that the air exhausting from the rear vent trim does not flow toward a user where it might possibly blow uncomfortable heated air against a user.

Other features and advantages of the present invention will become apparent to those skilled in the art upon review of the following detailed description and drawings.

BRIEF DESCRIPTION OF THE DRAWINGS

These and other aspects and features of embodiments of the present invention will be better understood after a reading of the following detailed description, together with the attached drawings, wherein.

DETAILED DESCRIPTION OF THE EXEMPLARY EMBODIMENTS OF THE INVENTION

Figure 1:
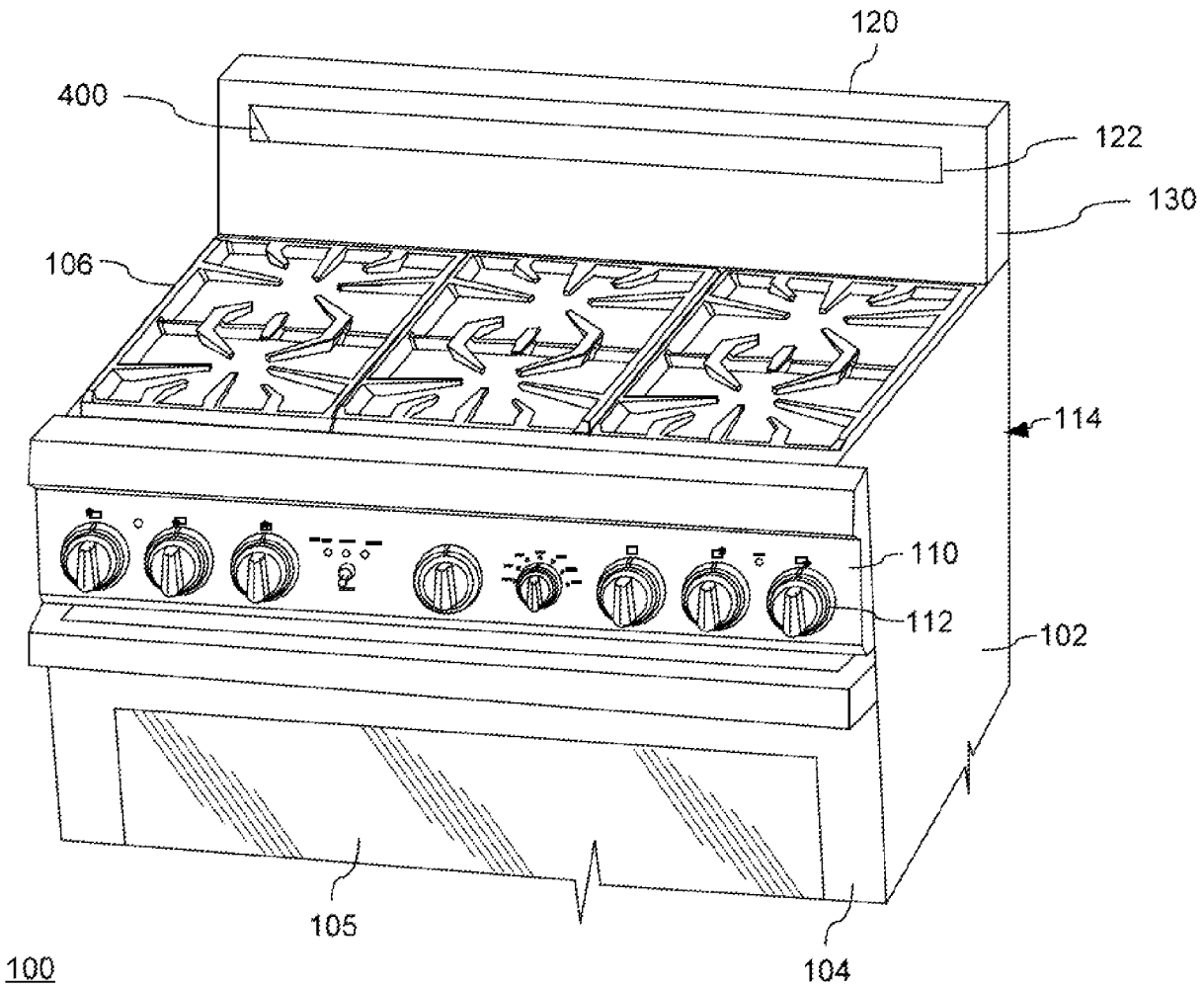
FIG. 1 is a partial, perspective view of a home cooking appliance according to an exemplary embodiment of the invention.

The present invention now is described more fully hereinafter with reference to the accompanying drawings, in which embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art.

Referring now to the drawings, FIGS. 1-18 illustrate exemplary embodiments of a home cooking appliance having a rear vent trim, and more particularly, a home cooking appliance having a rear vent trim including a side shield.

Figure 2:
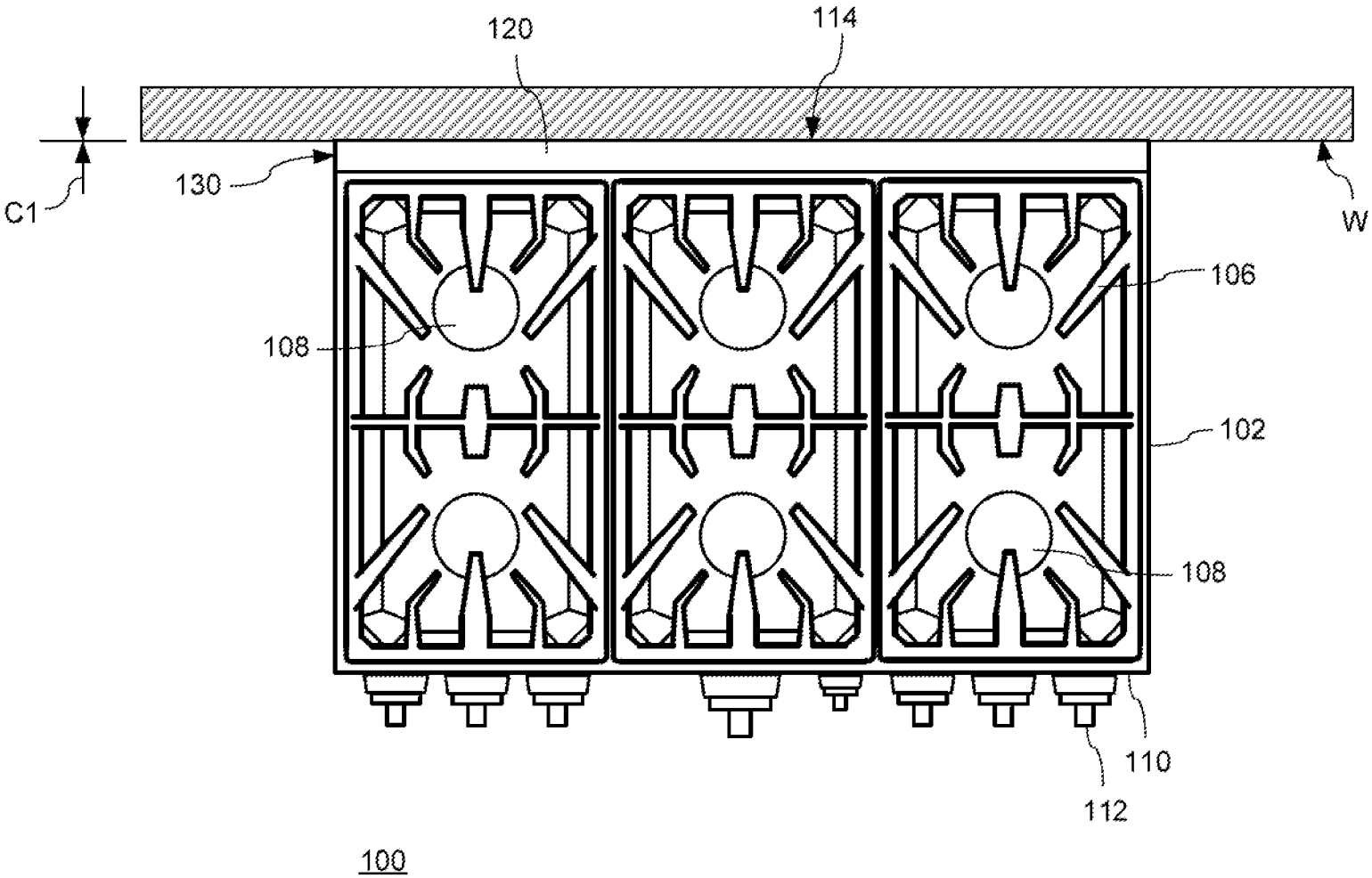
FIG. 2 is a top view of a home cooking appliance according to an exemplary embodiment of the invention.

With reference to FIGS. 1 and 2, an exemplary embodiment of a home cooking appliance 100, such as a Free Standing Range (FSR), will first be described. As shown in FIGS. 1 and 2, the home cooking appliance 100 may have a housing 102 with a cooking compartment, such as a baking oven, convection oven, steam oven, warming drawer, etc., in the housing 102 and accessible through a door 104 in a front of the housing 102. The door 104 can include a door glass 105 for viewing the interior of the cooking compartment. The home cooking appliance 100 has a cooking surface 106 on a top of the housing 102. The cooking surface 106 can include, for example, one or more cooking grates having an upper surface for supporting cookware over one or more gas burners 108. The appliance is not limited to the illustrated embodiment, and can additionally or alternatively include other cooking compartments, such as one or more baking ovens, convection ovens, steam ovens, warming drawers, broil burner, etc., or one or more cooking surfaces, such as a griddle, an induction cooktop with a glass ceramic cooking surface, etc. The appliance 100 includes a control panel 110 having a plurality of user input features, such as control knobs 112 for controlling the operation of the burners 108 and the cooking compartment.

The housing 102 can include a rear vent trim for exhausting air from within the appliance, such as hot flue gases from the oven compartment. The rear vent trim can take various forms depending on the particular appliance, arrangement of cooking compartment(s), cooktop or burners, desired aesthetics of the appliance, and/or the location in which the appliance will be installed, such as adjacent to a kitchen wall, in a kitchen island, adjacent to cabinetry or other accessories such as a fume hood, etc., among other things. For example, the rear vent trim can be configured to be raised up from the cooking surface by various amounts such as a high back, low back, high shelf, etc., or substantially flush with the top of the appliance or cooking surface. In the illustrated example, the housing 102 includes a rear vent trim 120 on the top of the housing 102 and at a rear side of the cooking surface 106. The rear vent trim 120 extends upward from the top of the appliance and includes a vent opening 122 for exhausting air from within the appliance, including flue gases from one or more oven flues. The rear vent trim 120 is configured to control and manage the flow of the exhausted air (e.g., hot air/flue gas) to minimize temperatures on a user and adjacent surfaces, such as surfaces of kitchen cabinetry adjacent to or above the appliance, surfaces of a combustible back wall (see W in FIG. 2) of the kitchen, etc. In this way, the rear vent trim can improve compliance of the appliance with industry standards and regulations and maintain passing combustion results at the gas burners 108, while also improving comfort of a user, for example, by minimizing a temperature of air flowing toward the user, minimizing noise to the user, etc.

As shown in FIG. 2, the appliance 100 can be configured to be positioned such that the rear wall 114 is close to a combustible surface, such as a back wall W of a kitchen. The temperature of the rear wall 114 of the appliance during operation of the appliance greatly affects a required minimum clearance C1 between the rear wall 114 of the appliance 100 and a combustible back wall W of the kitchen, which faces the rear wall 114 of the appliance, in order to minimize heat transfer from the rear wall 114 to the back wall W of the kitchen. As shown in FIG. 2, the rear wall of the appliance typically is inaccessible or not exposed to a user during operation of the appliance when the appliance is up against the back wall of a kitchen. However, with a rear vent trim (e.g., 120) that rises up from the cooking surface, the side walls 130 of the rear vent trim 120 may exposed above the top of the appliance and/or be accessible from the side of the appliance due to the adjacent cabinetry or counters being level with the top of the appliance. As a result, it may be more likely that a user, or even an item on an adjacent counter, may come into contact with the side walls 130 of the rear vent trim 120. The appliance 100 includes a side shield, and more particularly a rear vent trim including a side shield 400, which will be described in greater detail below with reference to FIGS. 3-18, and which is configured to reduce the amount of heat transferred from the oven exhaust vents to a side wall of the appliance, and particularly to a side wall 130 of the rear vent trim of the appliance, thereby limiting or reducing the temperature exposure at the side wall 130 to a user. The appliance can include a side shield at each side of the rear vent trim 120.

Figure 3:
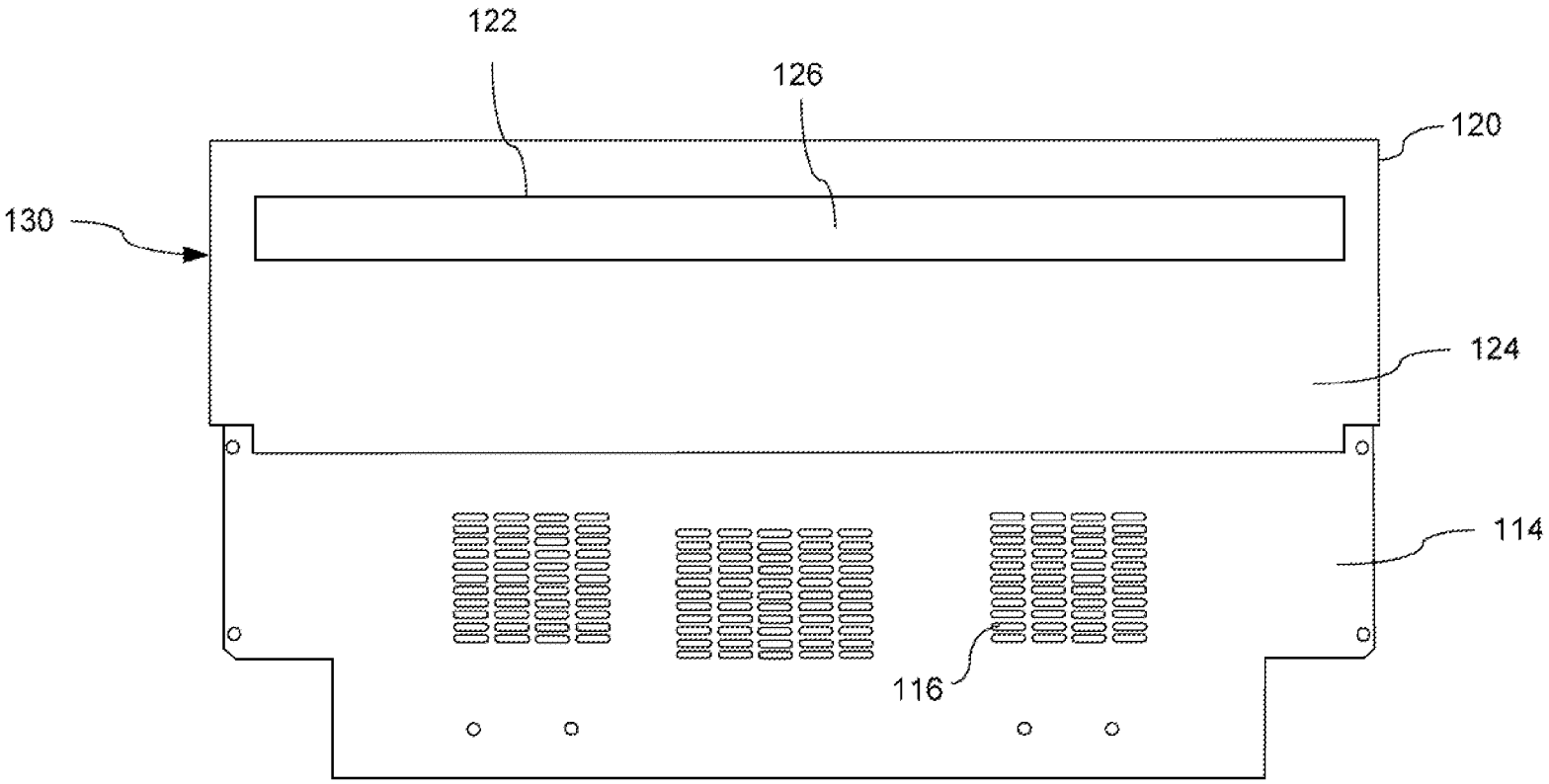
FIG. 3 is a front view of an oven vent trim and rear cover assembly of a home cooking appliance according to an exemplary embodiment of the invention.
Figure 4:
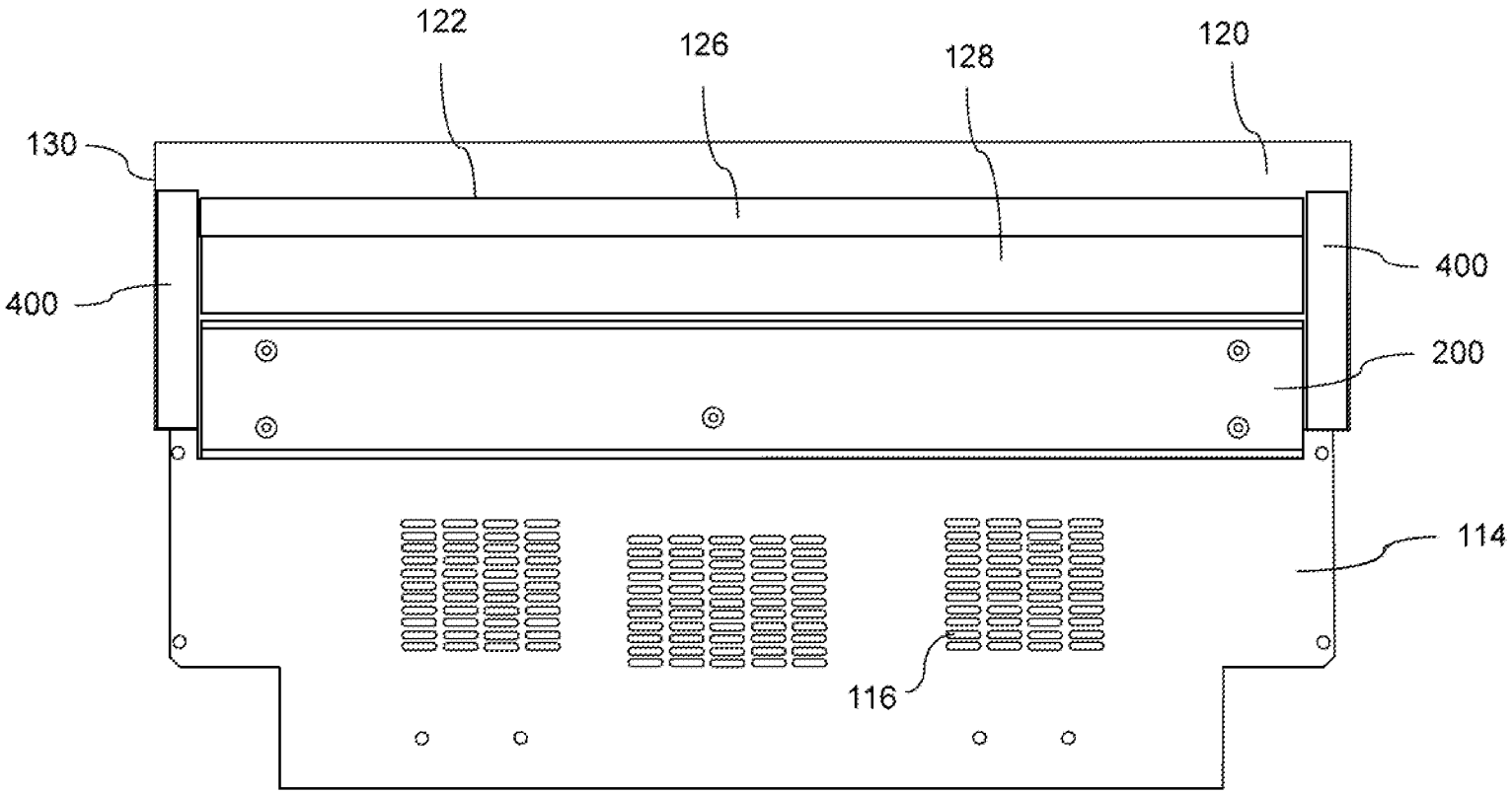
FIG. 4 is a cutaway, front view of an oven vent trim and rear cover assembly of a home cooking appliance according to an exemplary embodiment of the invention.
Figure 5:
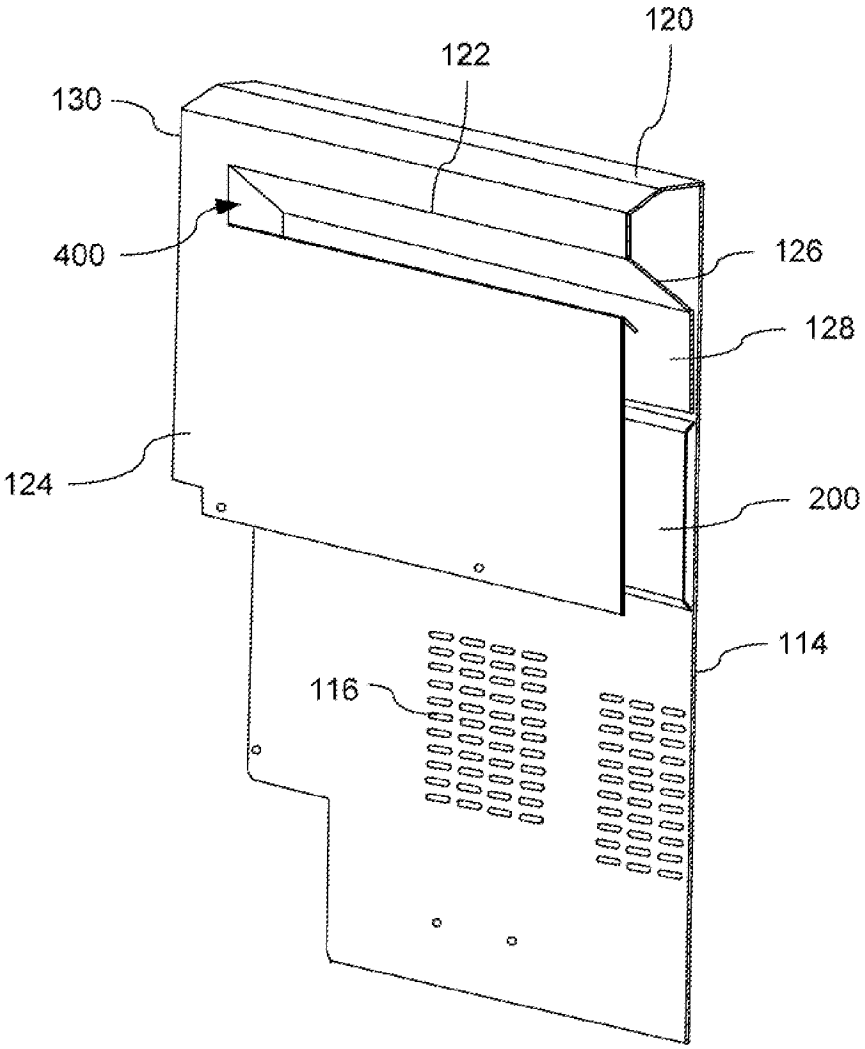
FIG. 5 is a cutaway, partial perspective view of an oven vent trim and rear cover assembly of a home cooking appliance according to an exemplary embodiment of the invention.
Figure 7:
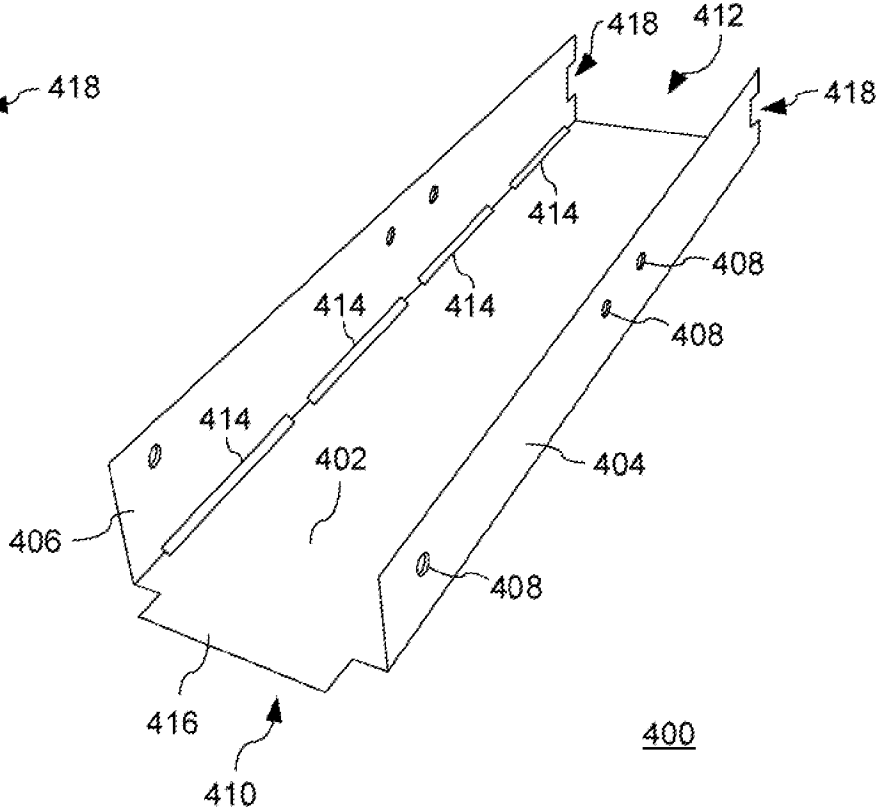
FIG. 7 is another perspective view of the side shield according to the exemplary embodiment illustrated in FIG. 6.
Figure 6:
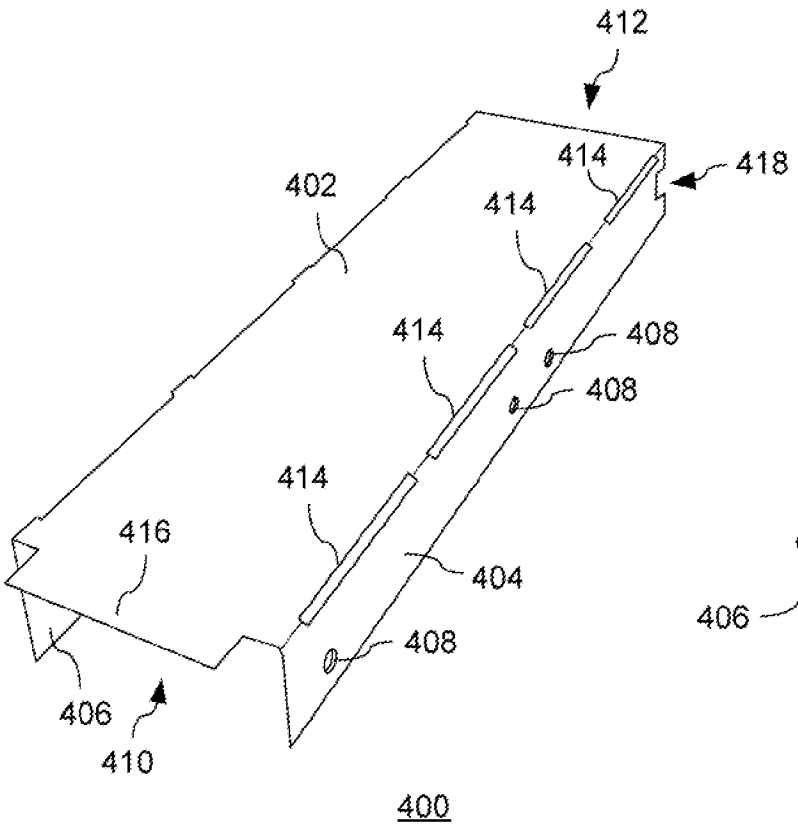
FIG. 6 is a perspective view of a side shield of a home cooking appliance according to an exemplary embodiment of the invention.
Figure 8:
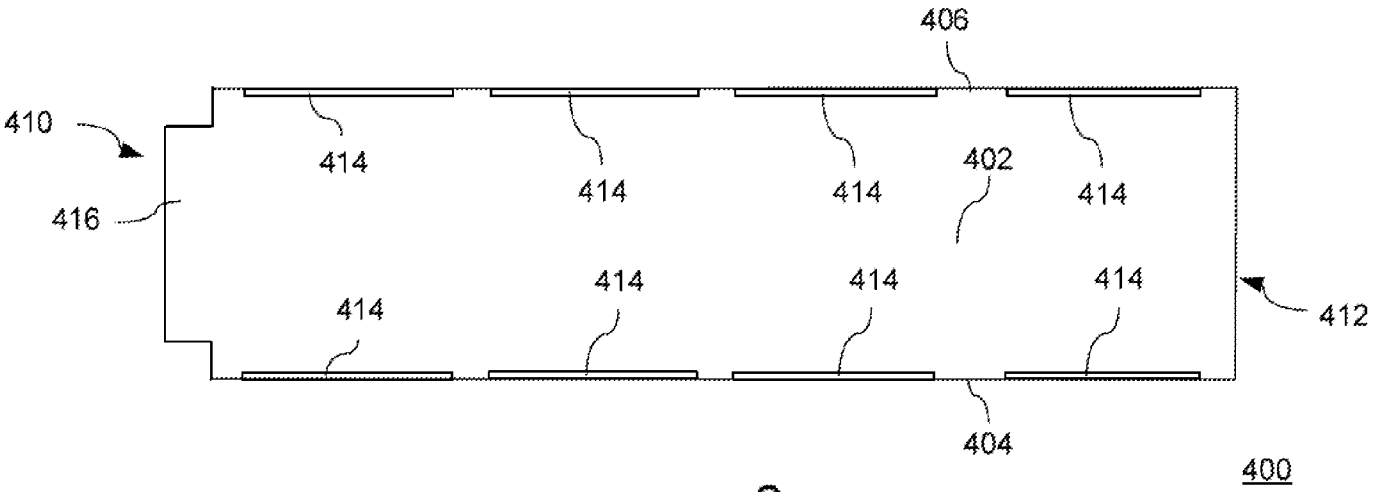
FIG. 8 is a side view of the side shield, according to the exemplary embodiment illustrated in FIG. 6, viewed from a side configured to face an exhaust channel.
Figure 9:
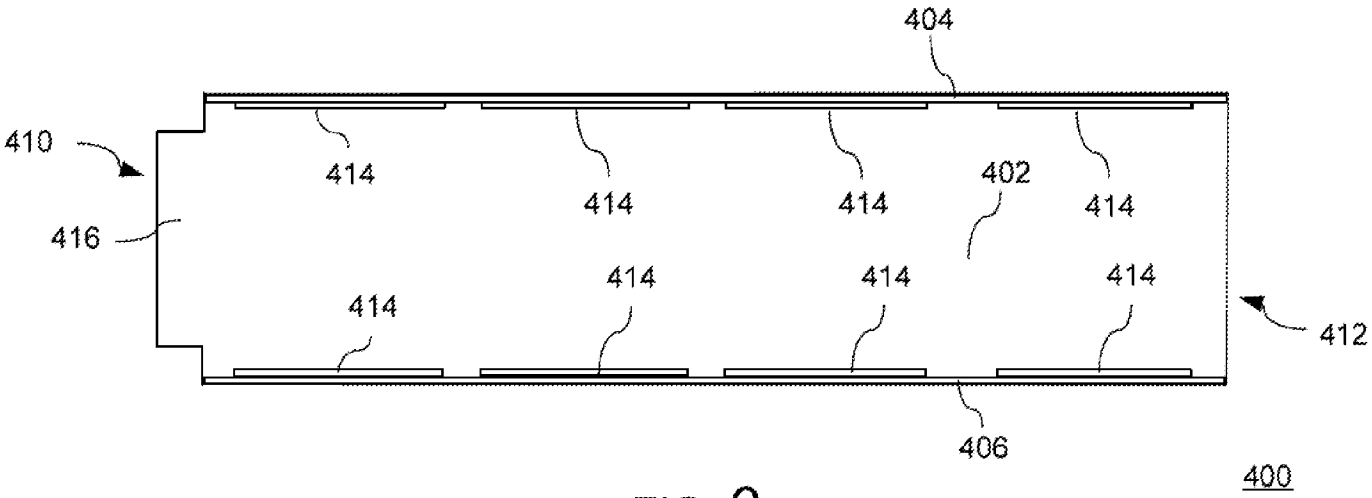
FIG. 9 is another side view of the side shield, according to the exemplary embodiment illustrated in FIG. 6, viewed from a side configured to face a side wall of the appliance.
Figure 10:
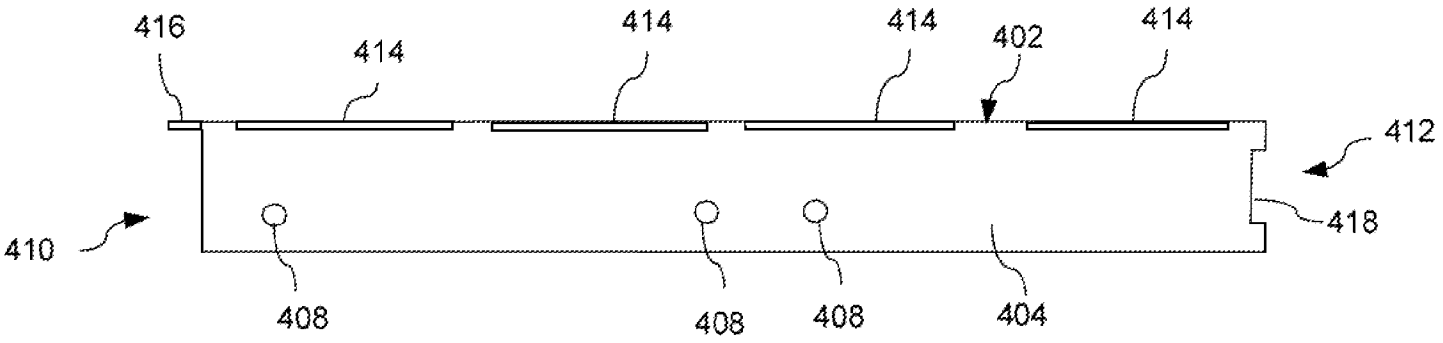
FIG. 10 is a rear view of the side shield according to the exemplary embodiment illustrated in FIG. 6.

FIGS. 3-5 illustrate an oven vent trim and rear wall assembly of a home cooking appliance 100 according to an exemplary embodiment of the invention. As shown in FIG. 3, the oven vent trim 120 includes a front face 124, which has an opening 122 for exhausting air, such as flue gases, from within the appliance, and side walls 130. The oven vent trim 120 includes a deflector 126 within the opening 122 that is configured to deflect the air being exhausted from the appliance in a predetermined direction, such as, for example, in a direction away from the back wall of the kitchen and above the top of the appliance. The rear wall 114 can include one or more openings or vents 116 configured to permit air from outside the appliance to enter the housing of the appliance, for example, for cooling components and/or mixing with hot flue gases. The air vents 116 are illustrated as being positioned below the rear vent trim 120 in the example embodiment. In other embodiments, additionally or alternatively, one or more air vents 116 can be disposed in the portion of the rear wall 114 adjacent to or directly behind the rear vent trim 120.

FIG. 4 illustrates the oven vent trim and rear wall assembly with the front face 124 removed to illustrate the interior components. As shown in FIGS. 4 and 5, a side shield 400 can be provided between a side wall and an exhaust channel, which guides air from an oven flue (not shown) to the oven vent 122. In this example, the exhaust channel is formed between the inner surface of the front face 124 of the rear vent trim 120 and the rear wall 114 of the appliance. The side shield 400 is configured to reduce the amount of heat that is transferred from the hot air, which is flowing from the oven flue through the exhaust channel, to the side wall 130, thereby limiting or reducing a temperature of the side wall 130 during operation of the oven, which in turn limits or reduces the temperature exposure to a user.

The side shield 400 can be positioned adjacent to a surface of the side wall 130 (e.g., an inner surface of the side wall) that is subject to temperature increases during operation of the appliance, such as a surface that is adjacent to or directly faces the exhaust channel from the oven flues. A side shield 400 can be configured to form an air gap between the side shield 400 and an inner surface of the side wall 130 of the appliance. The air gap can reduce the amount of heat that is transferred from the side shield 400 (which is heated by the hot air that flows from the oven flue through the exhaust channel) to the side wall 130. As a result, during operation of the appliance, a temperature of the side wall 130 is less than a temperature of the side shield 400, which in turn limits or reduces the temperature exposure to a user.

The particular location, arrangement, size, and shape of the side shield 400 can vary depending on the particular physical dimensions of one or more components of the appliance, such as an amount of available space between the flue fan exits and the side walls 130, the deflector 126, etc., the oven vent location(s), the number of oven vents or oven flues, the air flow through the exhaust channel, etc. The side shield 400 can be formed from a single part or from a plurality of parts. The side shield 400 can be formed separately from other components of the appliance, or integrally formed with other components.

With reference again to FIGS. 4 and 5, an air gap insulator 200 can be provided on an inner surface of the rear wall 114 at a location of an exhaust channel, which guides air from an oven flue (not shown) to the oven vent 122. The air gap insulator 200 is configured to reduce the amount of heat that is transferred from the hot air, which is flowing from the oven flue through the exhaust channel, to the rear wall 114, thereby limiting or reducing a temperature of the rear wall 114 during operation of the oven, which in turn limits or reduces the temperature exposure to a back wall W of the kitchen to which the wall 114 of the appliance 100 is adjacent. The air gap insulator 200 can be positioned on a surface of the rear wall 114 (e.g., an inner surface of the rear wall 114) that is subject to temperature increases during operation of the appliance, such as a surface that is adjacent to or directly faces the exhaust channel from the oven flues. The location, size, and shape of the air gap insulator 200 can vary depending on the particular physical dimensions of one or more components of the appliance, such as an amount of available space between the flue fan exits and the deflector 126, the oven vent location(s), the number of oven vents or oven flues, the air flow through the exhaust channel, etc. In the illustrated example, the air gap insulator 200 is positioned on the rear wall 114 directly below a mounting flange 128 of the deflector 126. The air gap insulator 200 can directly abut the deflector 126, or a mounting flange 128 of the deflector 126, or be spaced from the deflector 126 or a mounting flange 128 of the deflector 126. The air gap insulator 200 can be positioned below the deflector 126 such that the air gap insulator 200 cannot be viewed readily by a user of the appliance through the opening of the oven vent 122. The air gap insulator 200 can be formed from a single part or from a plurality of parts. The air gap insulator 200 can be formed separately from other components of the appliance, or integrally formed with other components, such as the deflector 126, or a mounting flange 128 of the deflector 126. The arrangement, size, and shape of the air gap insulator 200 also can vary depending on the particular physical dimensions of one or more components of the appliance, the oven vent location(s), the number of oven vents or oven flues, the air flow through the exhaust channel, etc.

With reference to FIGS. 6-11, an exemplary embodiment of a side shield 400 will now be described.

The side shield 400 includes a plate portion 402 having a surface arranged to be exposed (e.g., directly exposed) to flue gases (e.g., air A1 in FIG. 16) flowing through an exhaust channel (e.g., 300 in FIG. 16) from an oven flue (not shown) to the oven vent 122. The plate portion 402 can be arranged to be parallel to the flow of air A1 in the exhaust channel.

The side shield 400 can include a first flange 404 and/or a second flange 406. The first flange 404 and/or the second flange 406 can include one or more openings 408 for receiving one or more fasteners for mounting the side shield 400 to the appliance. A first end 410 of the side shield 400 can include a projection or tab 416, for example, for extending the surface of the plate portion 402 beyond the mounting flanges. A second end 412 can include one or more fixation or locating devices, such as cutouts or notches 418, configured for example to engage corresponding features on the appliance to provide proper alignment and installation of the side shield 400.

The side shield 400 can be configured such that a portion of the side shield 400 that comes into direct contact with the heated air in the exhaust channel can be at least partially isolated from conducting heat to other portions of the side shield 400 that contact other surfaces of the appliance, such as surfaces of one or more flanges 404, 406 that contact other surfaces of the appliance when the side shield 400 is in a mounted position on the appliance. For example, the side shield 400 can include one or more openings, cutouts, slots, holes, notches, or the like (e.g., slots 414) between a plate portion 402, which comes into direct contact with the heated air in the exhaust channel, and the mounting flange(s) 404, 406, thereby reducing an amount of material in the side shield 400 that may conduct heat between the portions of the side shield 400, which in turn may reduce an amount of heat transferred by the side shield 400 to other components or surfaces of the appliance. The one or more openings, cutouts, slots, holes, notches, or the like, (e.g., slots 414) can have any suitable size or shape, depending on the particular arrangement, the number of oven vents or oven flues, the air flow through the exhaust channel, etc. of the side shield and other components. The one or more openings, cutouts, slots, holes, notches, or the like, (e.g., slots 414) can be formed, for example, along a bend or fold between the plate portion 402 and one or more of the mounting flanges 404, 406. Additionally or alternatively, the one or more openings, cutouts, slots, holes, notches, or the like (e.g., slots 414) can be formed in other locations that may reduce or limit an amount of heat that is conducted from one portion of the side shield 400 to another portion of the side shield 400. For example, the one or more cutouts, slots, holes, or the like (e.g., slots 414) can be disposed only on the plate portion 402 between a first part of the plate portion 402, which comes into direct contact with the air in the exhaust channel, and a second part of the plate portion 402, which does not come into direct contact with the air in the exhaust channel, such as a part of the plate that is covered, or prevented from direct contact with the air, by an adjacent component (e.g., an air gap insulator 200, which covers a part of the side shield 400 facing the exhaust channel, as described in more detail below with reference to FIGS. 12-16). In operation, the one or more cutouts, slots, holes, or the like (e.g., slots 414) may be configured to permit some cooling air, for example from air slots 116 in the rear wall 114 of the appliance, to enter the gap between the side shield 400 and the side wall 130, thereby improving cooling within the air gap.

The side shield 400 can be configured to provide for a smooth flow of air over the surface 402 of the side shield 400. For example, the surface 402 of the side shield 400 facing the exhaust channel can be a planar surface, angled surface, or curved surface to smooth the flow of air over the surface of the side shield 400 and/or prevent a build-up of heat along the surface of the side shield 400, for example due to stagnant air. In the illustrated embodiment, the plate portion 402 of the side shield 400 facing the exhaust channel is a planar surface. The side shield 400 can be configured to be open at least at a first end (i.e., an upstream end) 410 of the side shield 400 or at both ends 410, 412 of the side shield 400.

Figure 11:
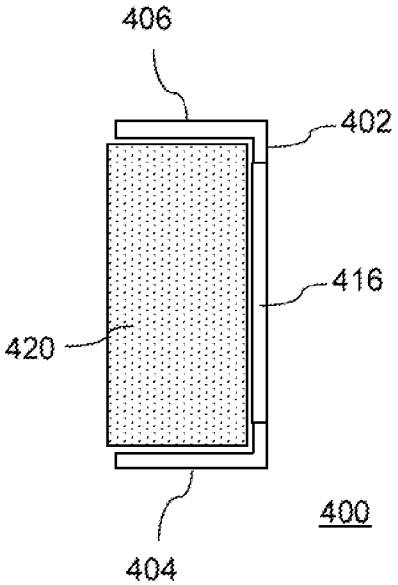
FIG. 11 is an end view of the side shield according to the exemplary embodiment illustrated in FIG. 6.

As shown in FIG. 11, in an exemplary embodiment, the side shield 400 can include a layer of insulation 420, such as insulation typically used in oven applications, granular insulations, etc., in an air gap formed between the side shield 400 and the side wall 130. The insulation 420 can not only serve to further limit a transfer of heat from the exhaust channel to the side wall 130, but also can reduce or restrict air flow into the gap formed by the side shield 130 to prevent heated air from flowing into the gap without entirely cutting off air flow in the gap. In this way, the side shield 400 having insulation in the air gap can permit some limited or minimal movement of air within the insulation in the gap, which may assist with cooling while at the same time reducing or eliminating the possibly of a hot spot forming, and/or reducing or eliminating the flow of air from the exhaust channel into the gap. One of ordinary skill in the art will understand that the insulation 420 does not need to completely fill the air gap formed between the side shield 400 and the side wall 130. In other embodiments, the insulation 420 may fill only a part of the air gap formed between the side shield 400 and the side wall 130. In still other embodiments, the air gap formed between the side shield 400 and the side wall 130 may be empty (e.g., devoid of insulation).

The example side shield 400 illustrated in FIGS. 6-11 has a three-sided or U-shaped arrangement formed by the plate portion 402 and flanges 404, 406 formed on each side of the plate portion 402. The openings 408, slots 414, flanges 404, 406, and location/fixation devices 418 are arranged to be symmetrical on the plate portion 402. In this way, the side shield 400 can be universal for either side of the appliance. When installed, the side shield 400 may be coupled to the appliance using one or both of the flanges 404, 406. As previously discussed, the arrangement, size, and shape of the air gap insulator 200 also can vary depending on the particular physical dimensions of one or more components of the appliance, the oven vent location(s), the number of oven vents or oven flues, the air flow through the exhaust channel, etc. For example, in another embodiment, the side shield can be formed with a single flange for mounting the side shield to the appliance (e.g., an L-shaped arrangement). In this example, separate side shields with different designs may be needed for each side of the rear vent trim, rather than being universal to both sides.

With reference to FIGS. 12-16, the side shield 400 can be positioned adjacent to a surface of the side wall 130 (e.g., an inner surface of the side wall 130) that is subject to temperature increases during operation of the appliance, such as a surface that is adjacent to or directly faces the exhaust channel 300 from the oven flues. The side shield 400 can be configured to provide for a smooth flow of air A1 over the surface of the side shield 400. For example, the surface of the side shield 400 facing the exhaust channel 300 can be a planar surface, angled surface, or curved surface to smooth the flow of air over the surface of the side shield 400 and/or prevent a build-up of heat along the surface of the side shield 400, for example due to stagnant air.

Figure 12:
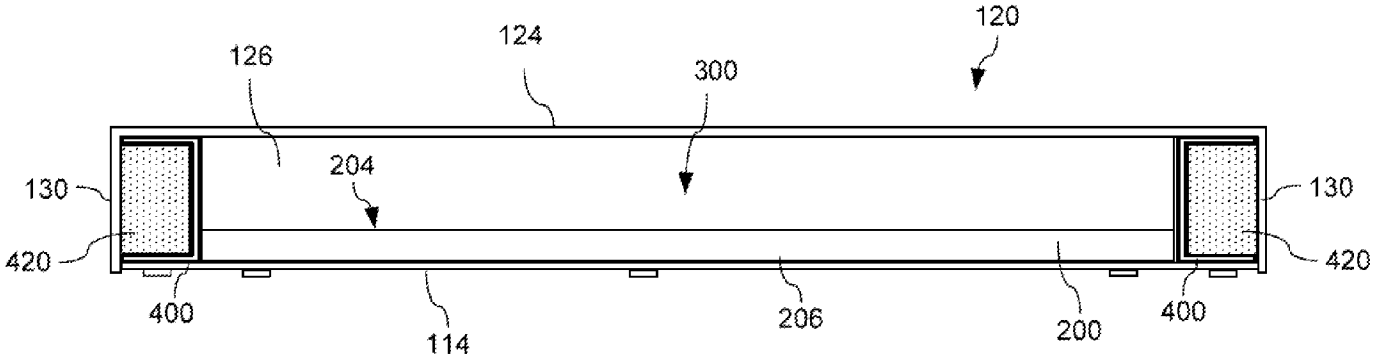
FIG. 12 is a view of an oven vent trim and rear cover assembly, viewed from an upstream side, according to an exemplary embodiment of the invention.

The side shield 400 forms an air gap between the side shield 400 and an inner surface of the side wall 130 of the appliance (the air gap is illustrated as being filled with insulation 420 in the exemplary embodiment illustrated in FIG. 12). The air gap can reduce the amount of heat that is transferred from the side shield 400 (which is heated by the hot air that flows from the oven flue through the exhaust channel 300) to the side wall 130. As a result, during operation of the appliance, a temperature of the side wall 130 is less than a temperature of the side shield 400, which in turn limits or reduces the temperature exposure to a user.

The side shield 400 can be configured to substantially minimize or prevent air from flowing into the air gap from the exhaust channel 300, thereby minimizing or preventing hot air from the exhaust channel 300 from directly contacting the surface of the side wall 130 that faces the air gap. The side shield 400 can be configured to restrict or prevent any air flow in the air gap, but preferably is not completely closed off with a solid wall or solid surface in a manner that creates an area of limited or no air flow, which may result in a hot spot (e.g., an accumulation of higher temperature air). In the illustrated example embodiment, the side shield 400 is open at both ends of the side shield 400. The upstream end of the side shield 400 can be configured to extend past (e.g., below) an exit of the oven flue (e.g., below the top of the oven flue), thereby restricting or preventing air from the oven flue from entering the air gap formed between the side shield 400 and the side wall 130. The open end or ends 410, 412 of the side shield 400 can be configured to permit some air to enter the gap, for example from air slots 116 in the rear wall 114 of the appliance, thereby improving cooling within the air gap.

The side shield 400 can include a layer of insulation 420, such as insulation typically used in oven applications, granular insulations, etc., in the air gap formed between the side shield 400 and the side wall 130. The insulation 420 can not only serve to further limit a transfer of heat from the exhaust channel 300 to the side wall 130, but also can reduce or restrict air flow into the gap to prevent heated air from flowing into the gap without entirely cutting off air flow in the gap. In this way, the side shield 400 having insulation in the air gap can permit some limited or minimal movement of air within the insulation in the gap, and more particularly within the insulation 420 in the gap, which may assist with cooling while at the same time reducing or eliminating the possibly of a hot spot forming, and/or reducing or eliminating the flow of air from the exhaust channel 300 into the gap.

Figure 13:
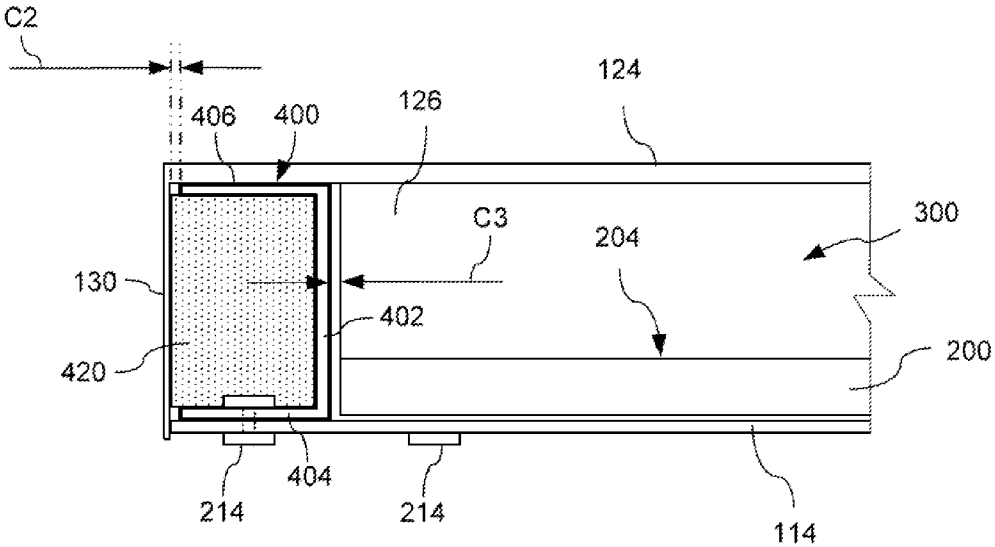
FIG. 13 is a partial view of the oven vent trim and rear cover assembly according to the exemplary embodiment illustrated in FIG. 12, viewed from an upstream side.

As shown in the example in FIG. 13, the side shield 400 can be mounted on the appliance such that the side shield 400 does not contact the side wall 130 of the appliance, thereby minimizing or preventing the side wall 130 from conducting heat from the side shield 400. The side shield 400 can be spaced by a minimal amount or clearance C2 from a surface of the side wall 130, thereby restricting or eliminating heat transfer from one solid to another solid (e.g., metal to metal). In this way, the exemplary embodiments of the side shield 400 can significantly reduce the temperature of the side wall 130 of the appliance and particularly the side wall 130 of the rear vent trim assembly. This arrangement also may limit or reduce an amount of heat that is dispersed or conducted throughout the side wall 130 to other portions of the side wall 130 or adjacent rear wall 114, away from the particular location of the side shield 400. The side shield 400 may be formed without a wall corresponding to or facing the side wall 130, thereby minimizing an amount of material of the side shield 400 in proximity to the side wall 130, which may further minimize heat transfer from the side shield 400 to the side wall 130.

With reference again to FIGS. 12 and 13, to minimize heat transfer from other components to the side shield 400, the plate portion 402 of the side shield 400 can be arranged to be spaced by a minimal amount or clearance C3 from any adjacent surfaces, such as an air gap insulator 200. Such minimal spacing or clearance C3 between the plate portion 402 of the side shield 400 and other components can permit air (e.g., small amounts of air) to be drawn into the space between the side shield 400 and other components and provide some cooling of the plate portion 402 of the side shield 400, which may limit or reduce heat transfer from the air gap insulator 200 to the rear wall 114. Moreover, the heat transfer from any other components to the plate portion 402 of the side shield 400 (i.e., from one solid to another solid; metal to metal) can be substantially limited or reduced.

Figure 16:
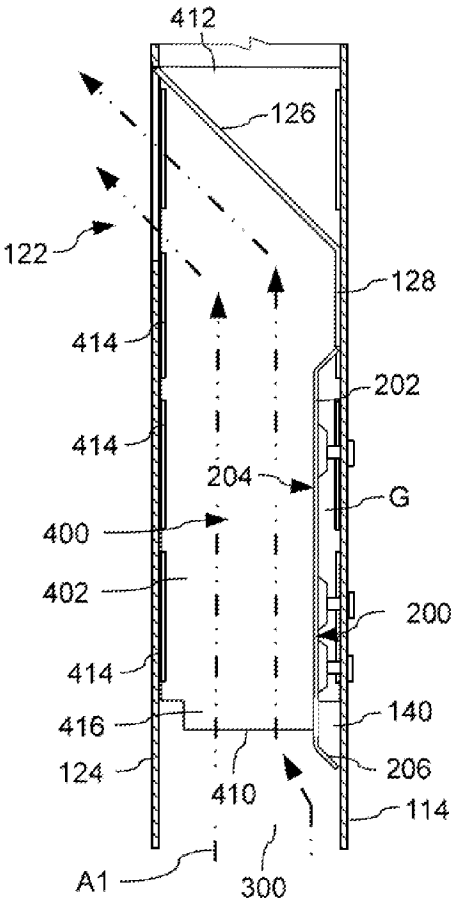
FIG. 16 is a cut-away side view of the oven vent trim and rear cover assembly of FIG. 14, according to an exemplary embodiment, viewed from a side facing the exhaust channel of the appliance.
Figure 15:
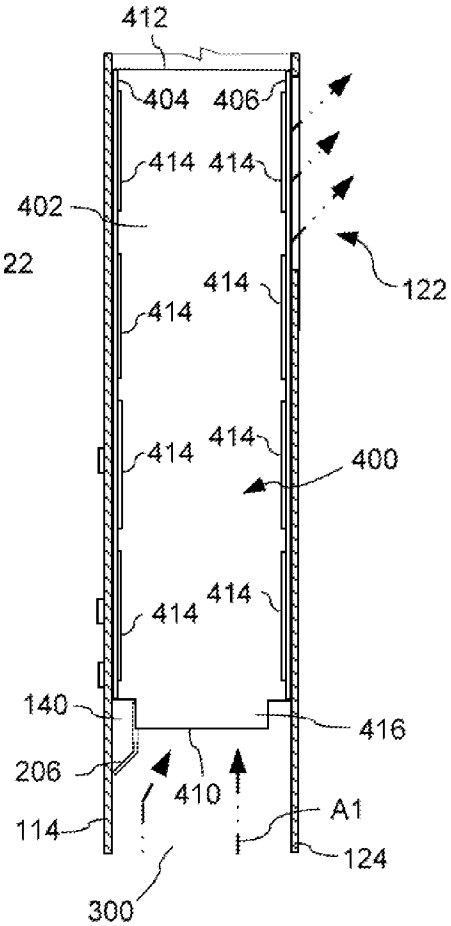
FIG. 15 is another cut-away side view of the oven vent trim and rear cover assembly of FIG. 14 without the insulation member, viewed from a side facing the side wall of the appliance.
Figure 14:
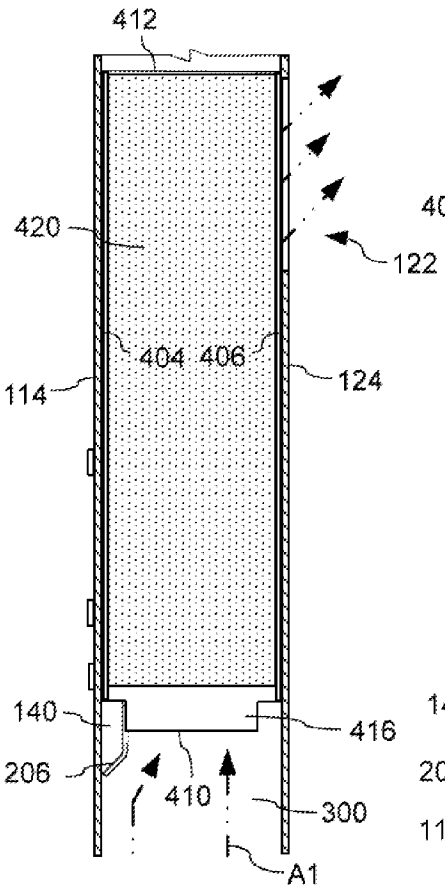
FIG. 14 is a cut-away side view of an oven vent trim and rear cover assembly having an insulation member, according to an exemplary embodiment, viewed from a side facing the side wall of the appliance.

As shown in FIGS. 14-16, the plate portion 402 of the side shield 400 that comes into direct contact with the heated air in the exhaust channel 300 can be at least partially isolated from conducting heat to other portions of the side shield 400 that contact other surfaces of the appliance, such as surfaces of one or more flanges 404, 406 that contact other surfaces of the appliance when the side shield 400 is in a mounted position on the appliance. The side shield 400 includes a plurality of slots 414 between a plate portion, which comes into direct contact with the heated air in the exhaust channel 300, and the mounting flange(s), thereby reducing an amount of material in the side shield 400 that may conduct heat between the portions of the side shield 400, which in turn may reduce an amount of heat transferred by the side shield 400 to other components or surfaces of the appliance. The slots 414 are formed, for example, along a bend or fold between the plate portion 402 and each of the mounting flange(s) 404, 406.

As shown in FIG. 16, the slots 414 can be configured to permit some cooling air, for example from air slots 116 in the rear wall 114 of the appliance, to enter the gap between the side shield 400 and the side wall 130, thereby improving cooling within the air gap.

The flange 404 of the side shield 400 can be coupled to the appliance using one or more fasteners, such as one or more rivets 214.

As shown in FIGS. 12-16, a surface of the side shield 400 that is exposed to the air in the exhaust channel 300 can be positioned to extend in a direction of the air flow A1 along and adjacent to an end of the air gap insulator 200. A clearance C3 can be provided between the end of the air gap insulator 200 and the side shield 400 to permit some air (e.g., small amounts of air) to be drawn into the low pressure area of the air gap G of the air gap insulator 200. The clearance C3 also may permit some air (e.g., small amounts of cooling air) to flow between the air gap formed by the side shield 400 and the air gap formed by the air gap insulator 200, for example, via one or more of the slots 414 in the side shield 400.

In the example embodiment, as shown in FIGS. 14-16, the side shield 400 is positioned with respect to the air gap insulator 200 such that an opening 140 in the end of the air gap insulator 200 facing the side shield 400 is exposed (i.e., not covered by the side shield 400). The opening 140 may permit some air (e.g., small amounts of air) to be drawn into the low pressure area of the air gap G of the air gap insulator 200, for example, from vent openings 116 formed in the rear wall 114 of the appliance.

Figure 17:
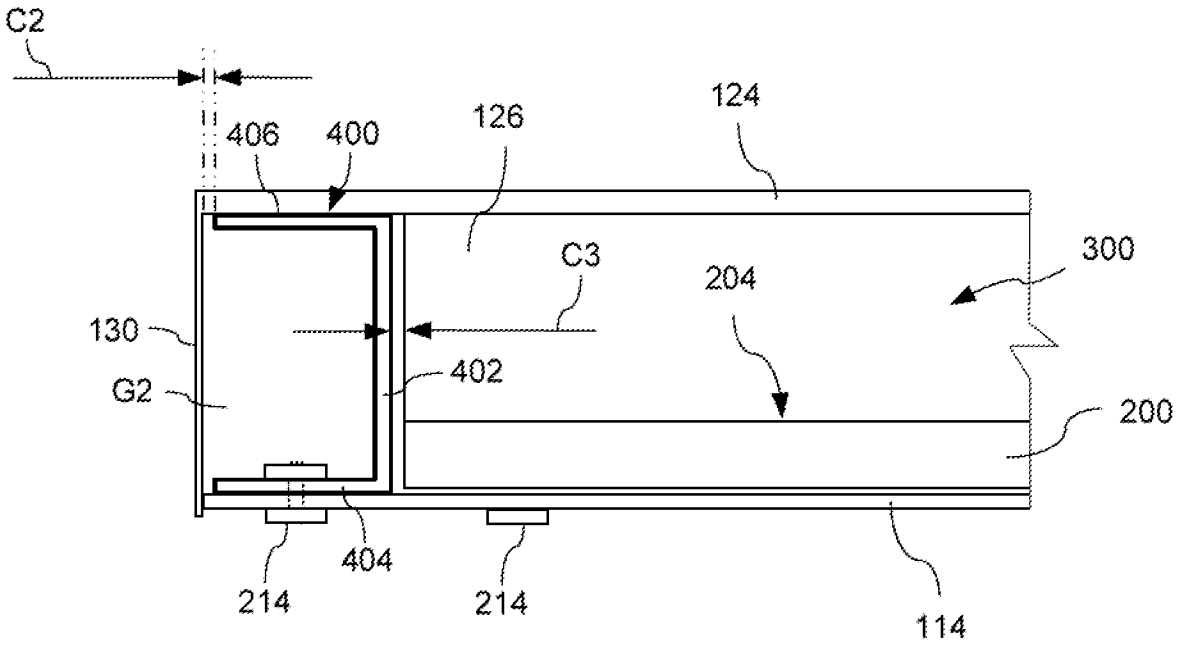
FIG. 17 is a partial, bottom view of an oven vent trim and rear cover assembly according to another exemplary embodiment of the invention, viewed from an upstream side.

With reference to FIG. 17, another exemplary embodiment of a rear vent trim is illustrated. In this example, the rear vent trim 120 includes a side shield 400, similar to the embodiments illustrated in FIGS. 12-16, without an insulation layer in the air gap G2 formed between the side shield 400 and the side wall 130.

Figure 18:
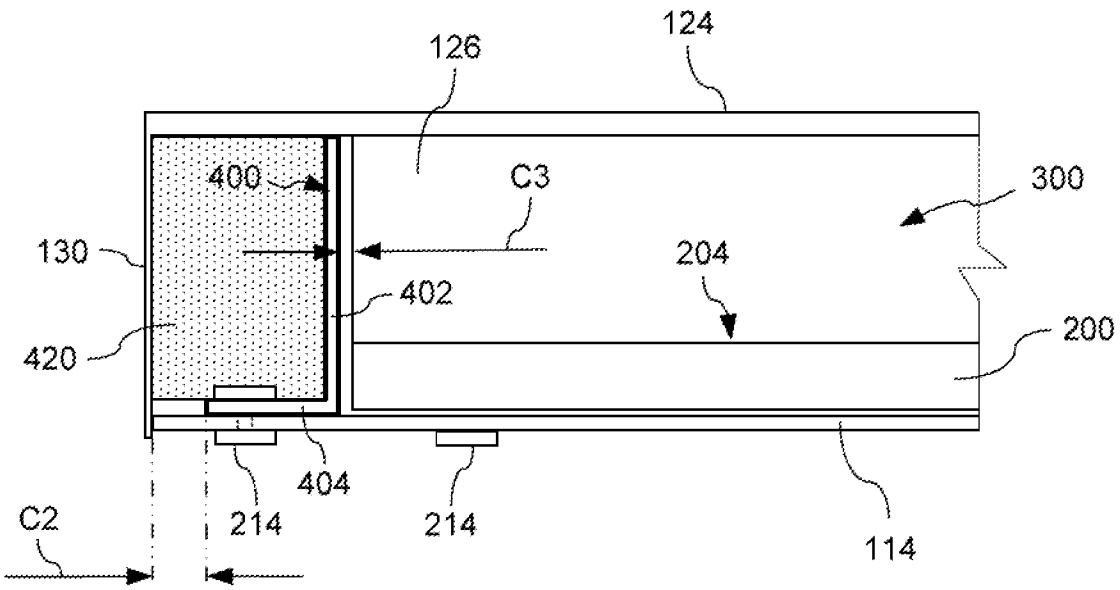
FIG. 18 is a partial, bottom view of an oven vent trim and rear cover assembly according to another exemplary embodiment of the invention, viewed from an upstream side.

With reference to FIG. 18, another exemplary embodiment of a rear vent trim is illustrated. In this example, the rear vent trim 120 includes a side shield 400 having an L-shaped arrangement. The side shield 400 only has a single mounting flange 404 for mounting the side shield 400 to the appliance. The insulation layer 420 can fill the space between the side shield 400, the side wall 130, and the front wall 124 of the rear vent trim. One of ordinary skill in the art will understand that the insulation 420 does not need to completely fill the air gap formed between the side shield 400 and the side wall 130. In other embodiments, the insulation 420 may fill only a part of the air gap formed between the side shield 400 and the side wall 130. In still other embodiments, the air gap formed between the side shield 400 and the side wall 130 may be empty (e.g., devoid of insulation).

With reference again to FIGS. 12-16, the rear vent trim 120 also can include an air gap insulator 200 mounted to the rear wall 114 and configured to form another air gap between the air gap insulator 200 and an inner surface of the rear wall 116 of the appliance, and more particularly, between the plate portion 202 of the air gap insulator 200 and the rear wall 114. As a result, during operation of the appliance, a temperature of the rear wall 114 can be maintained to be less than a temperature of the air gap insulator 200, which in turn limits or reduces the temperature exposure to a back wall W of the kitchen to which the wall 114 of the appliance 100 is adjacent. The air gap insulator 200 can be mounted to have minimal or limited contact with the rear wall 114 to minimize heat transfer from the air gap insulator 200 to the rear wall 114.

As shown in FIG. 16, a first flange 206 and second flange 208 can be configured to substantially close off the air gap G from the air A1 flowing in the exhaust channel 300, thereby minimizing or preventing hot air A1 from the exhaust channel from directly contacting the surface of the rear wall 114 adjacent to the air gap G. The arrangement of the first and second flanges 206 and 208 may result in a pressure difference between the air gap G and the exhaust channel, and particularly, a lower pressure in the air gap G than in the exhaust channel. To minimize heat transfer from the first flange 206 and the second flange 208 to the rear wall 114, the first flange 206 and the second flange 208 can be arranged to loosely contact the rear wall 114, or to be spaced by a minimal amount or clearance from the rear wall 114. Such minimal spacing or clearance between the first flange 206 and the second flange 208 and the rear wall 114 can permit air (e.g., small amounts of air) to be drawn into the low pressure area of the air gap, for example, from the openings 116 in the rear wall 114, which may provide some cooling of the air gap insulator 200 and/or generate a flow of cooler air within the air gap G, which may limit or reduce heat transfer from the air gap insulator 200 to the rear wall 114. Moreover, the heat transfer from one solid to another solid (e.g., metal to metal) can be substantially limited or reduced. This arrangement also may limit or reduce an amount of heat that is dispersed or conducted through the rear wall 114 to other portions of the rear wall 114, other than the particular location of the air gap insulator 200. This arrangement of the air gap insulator 200 may also minimize or prevent a build-up of heat along the edge of the first flange 206. One of ordinary skill in the art will recognize that, in some embodiments, the edge of each of the first or second flanges 206, 208 does not need to contact the rear wall 114 along its entire length, or alternatively, does not need to be separated from the rear wall 114 along its entire length. In some exemplary embodiments, in practice, some contact (e.g., incidental contact) between the edge of each of the first or second flanges 206, 208 and the rear wall 114 is possible within the spirit and scope of the invention.

As shown in FIGS. 12 and 13, to minimize heat transfer from one or both ends of the air gap insulator 200, the air gap insulator 200 can be arranged to be spaced by a minimal amount or clearance C3 from any adjacent surfaces, such as the plate portion 402 of the side shield 400. Such minimal spacing or clearance C3 between one or both ends of the air gap insulator 200 and the plate portion 402 of the side shield 400 can permit air (e.g., small amounts of air) to be drawn into the low pressure area of the air gap G, for example, from the openings 116 in the rear wall 114, which may provide some cooling of the air gap insulator 200 and/or generate a flow of cooler air within the air gap G, which may limit or reduce heat transfer from the air gap insulator 200 to the rear wall 114. Moreover, the heat transfer from the air gap insulator 200 to the plate portion 402 of the side shield 400 (i.e., from one solid to another solid; metal to metal) can be substantially limited or reduced.

The present invention has been described herein in terms of several preferred embodiments. However, modifications and additions to these embodiments will become apparent to those of ordinary skill in the art upon a reading of the foregoing description. It is intended that all such modifications and additions comprise a part of the present invention to the extent that they fall within the scope of the several claims appended hereto.

What is claimed is:

1. A home cooking appliance comprising:

a housing having a front wall, a rear wall, a first side wall, and a second side wall, wherein each of the first side wall and the second side wall couples the front wall to the rear wall;

a cooking compartment in the housing;

an exhaust channel that exhausts air from the cooking compartment; and a side shield disposed between the first side wall and the air flowing in the exhaust channel and forming an air gap between the first side wall and the exhaust channel.

2. The home cooking appliance of claim 1, wherein the side shield is configured to reduce an amount of heat transferred from the air in the exhaust channel to the first side wall.

3. The home cooking appliance of claim 1, wherein the side shield is spaced from a surface of the first side wall that faces the exhaust channel.

4. The home cooking appliance of claim 1, wherein the side shield includes insulation in the air gap between the first side wall and the exhaust channel.

5. The home cooking appliance of claim 4, wherein the insulation substantially fills the air gap between the first side wall and the exhaust channel.

6. The home cooking appliance of claim 1, wherein the side shield includes a plate portion facing the exhaust channel and having a surface arranged to be exposed to the air in the exhaust channel.

7. The home cooking appliance of claim 6, wherein the plate portion is configured to be parallel to a flow of the air in the exhaust channel.

8. The home cooking appliance of claim 6, wherein the side shield includes:

a first flange extending from a first side of the plate portion, the first flange configured to mount the side shield to the appliance.

9. The home cooking appliance of claim 8, wherein the side shield includes:

a second flange extending from a second side of the plate portion, the second side being opposite the first side.

10. The home cooking appliance of claim 8, wherein the first flange includes an opening for receiving a fastener.

11. The home cooking appliance of claim 8, wherein the first flange extends at an angle of substantially 90° from the plate portion toward the first side wall.

12. The home cooking appliance of claim 9, wherein each of the first flange and the second flange extends at an angle of substantially 90° from the plate portion toward the first side wall.

13. The home cooking appliance of claim 8, further comprising:

insulation along a surface of the plate portion from which the first flange extends.

14. The home cooking appliance of claim 1, wherein the side shield includes one or more openings configured to reduce heat conduction between a first portion of the side shield and a second portion of the side shield.

15. The home cooking appliance of claim 1, further comprising:

an air gap insulator disposed between the rear wall and the air flowing in the exhaust channel and forming a second air gap between the rear wall and the exhaust channel.

16. The home cooking appliance of claim 1, wherein the side shield includes a plate portion facing the exhaust channel and having a surface arranged to be exposed to the air in the exhaust channel; and a flange extending from the plate portion, the flange configured to mount the side shield to the rear wall of the appliance, wherein the side shield includes one or more openings between the plate portion and the flange, the one or more openings configured to reduce heat conduction between the plate portion and the flange.

17. The home cooking appliance of claim 1, wherein the side shield includes:

a plate portion having a surface facing an interior of the exhaust channel and arranged to be exposed to the air in the exhaust channel;

a first flange extending from a first side of the plate portion, the first flange configured to mount the side shield to the rear wall of the appliance; and a second flange extending from a second side of the plate portion, the second side being opposite the first side, wherein the plate portion, the first flange, and the second flange cooperate with the first side wall to form the air gap between the first side wall and the exhaust channel, wherein the plate portion, the first flange, and the second flange substantially close off the air gap from the air in the exhaust channel, and wherein the side shield includes insulation at least partially filling the air gap between the first side wall and the exhaust channel.

18. The home cooking appliance of claim 17, wherein an edge of an upstream end of the first flange is spaced from the rear wall, and wherein an edge of a downstream end of the second flange is spaced from the rear wall.

19. The home cooking appliance of claim 17, wherein an edge of the side shield extending in a direction parallel to a flow of the air in the exhaust channel is spaced from other components of the appliance.

20. The home cooking appliance of claim 1, further comprising:

a cooking surface on a top of the housing; and a rear vent trim on the top of the housing and at a rear side of the top of the housing, the rear vent trim having an opening in communication with the exhaust channel for permitting the air to exhaust from the housing.

21. The home cooking appliance of claim 1, wherein the opening of the rear vent trim is formed in a front face of the rear vent trim.

22. The home cooking appliance of claim 1, wherein the oven vent trim includes a deflector within the opening, the deflector configured to deflect the air being exhausted from the appliance in a predetermined direction.

23. The home cooking appliance of claim 22, wherein the side shield is positioned upstream of the deflector in the exhaust channel.

24. The home cooking appliance of claim 1, wherein the side shield comprises a plate portion between the exhaust channel and a surface of the first side wall that faces the exhaust channel, and wherein a surface of the plate portion is exposed to the air in the exhaust channel.

25. The home cooking appliance of claim 1, further comprising a second side shield disposed between the second side wall and the air flowing in the exhaust channel and forming a second air gap between the second side wall and the exhaust channel.

26. The home cooking appliance of claim 25, wherein the side shield comprises a plate portion between the exhaust channel and a surface of the first side wall that faces the exhaust channel, wherein a surface of the plate portion is exposed to the air in the exhaust channel, and wherein the second side shield comprises a second plate portion between the exhaust channel and a surface of the second side wall that faces the exhaust channel, wherein a surface of the second plate portion is exposed to the air in the exhaust channel.

27. A home cooking appliance comprising:

a housing having a front wall, a rear wall, a first side wall, and a second side wall, wherein each of the first side wall and the second side wall couples the front wall to the rear wall;

a cooking compartment in the housing;

an exhaust channel that exhausts air from the cooking compartment; and a side shield coupled to the housing between the first side wall and the exhaust channel, the side shield configured to form an air gap between the first side wall and the exhaust channel.

28. The home cooking appliance of claim 27, wherein the side shield substantially closes off the air gap from the air in the exhaust channel.

29. The home cooking appliance of claim 27, wherein the side shield includes one or more openings configured to reduce heat conduction between a first portion of the side shield and a second portion of the side shield.

30. The home cooking appliance of claim 27, wherein the side shield includes insulation in the air gap between the first side wall and the exhaust channel.

31. The home cooking appliance of claim 27, wherein the insulation substantially fills the air gap between the first side wall and the exhaust channel.

32. A home cooking appliance comprising:

a housing having a front wall, a rear wall, a first side wall, and a second side wall, each of the first side wall and the second side wall coupling the front wall to the rear wall;

a cooking compartment in the housing;

an exhaust channel that exhausts air from the cooking compartment, wherein the exhaust channel extends across the rear wall between the first side wall and the second side wall, and wherein the exhaust channel includes a portion adjacent to the first side wall; and a side shield coupled to the housing between the first side wall and the portion of the exhaust channel, the side shield configured to form an air gap between the first side wall and the portion of the exhaust channel that is adjacent to the first side wall.

33. The home cooking appliance of claim 32, wherein the side shield is mounted on the housing without directly contacting the first side wall.

34. The home cooking appliance of claim 32, wherein the side shield comprises:

a plate portion facing the portion of the exhaust channel; and a flange coupled to an edge of the plate portion, the flange configured to mount the side shield to the housing, wherein the side shield includes one or more openings along a connection between the plate portion and the flange to reduce heat conduction between the plate portion and the flange.

35. The home cooking appliance of claim 32, wherein the side shield is spaced from a surface of the first side wall that faces the exhaust channel.

36. The home cooking appliance of claim 35, wherein the side shield comprises a plate portion between the exhaust channel and the surface of the first side wall that faces the exhaust channel, and wherein a surface of the plate portion is exposed to the air flowing in the exhaust channel.

* * * * *